United States Patent [19]

Reiner et al.

[11] 4,002,339

[45] Jan. 11, 1977

[54] POKER POOL GAME

[76] Inventors: Lawrence L. Reiner, 1 Hickory Lane, Woodbury, N.Y. 11797; William A. Brady, 243 Teaneck Road, Ridgefield Park, N.J. 07660

[22] Filed: Nov. 20, 1974

[21] Appl. No.: 525,287

[52] U.S. Cl. ..... 273/123 A; 273/136 A; 273/136 K; 273/DIG. 26

[51] Int. Cl.[2] ..... A63F 7/00

[58] Field of Search ..... 273/123 A, 124 A, 125 A, 273/121 A, 59 R, 102, 136 R, 136 K, 137 A, 12

[56] References Cited

UNITED STATES PATENTS

| | | | |
|---|---|---|---|
| 1,524,375 | 1/1925 | Williams | 273/123 A |
| 1,578,005 | 3/1926 | Brooks | 273/14 |
| 1,612,912 | 1/1927 | Esmarian | 273/125 A |
| 1,614,471 | 1/1927 | Hayashi | 273/123 A |
| 1,678,573 | 7/1920 | Nakashima | 273/123 A |
| 1,784,068 | 12/1930 | Johnson | 273/14 |
| 2,237,746 | 4/1941 | Perks | 273/121 A |
| 2,640,697 | 6/1953 | Elersich | 273/12 |
| 3,051,490 | 8/1962 | Newman | 273/136 K |
| 3,347,460 | 10/1967 | Dickson | 273/136 K |
| 3,778,062 | 12/1973 | Sherwood | 273/121 A |

FOREIGN PATENTS OR APPLICATIONS

| | | | |
|---|---|---|---|
| 105 | 1/1932 | Australia | 273/123 A |

*Primary Examiner*—Richard C. Pinkham
*Assistant Examiner*—William R. Browne
*Attorney, Agent, or Firm*—Lackenbach, Lilling & Siegel

[57] ABSTRACT

A game of skill and strategy embodying a playing surface having corner pockets and two pair of side-pockets and a plurality of balls. A cue stick and cue ball are used to strike the balls and shoot for a particular poker hand. All of the pockets have an electrical switch, but some of the pockets close an electrical circuit for establishing or scoring a card hand, and other pockets open an electrical circuit for erasing one's opponents scoring cards from an electronic-like score board.

20 Claims, 15 Drawing Figures

A
K
Q
J
10
12
16
30
34
34'
35
36
38
40
46
50
52
54
56
57
66
68
70
78
3
4
5
6
9
10

PANEL NO. 1
12
12

POKER POOL GAME

BACKGROUND OF THE INVENTION

This invention relates to a game involving both skill and strategy, and, more particularly, to a game which combines the use of "Pool" characteristics and features with conventional card games, such as poker.

The poker pool game of the present invention is played on a table surface having a plurality of pockets. The playing surface is generally smaller than that of a conventional pool table, and the game is also equipped with an electronic-like score board displaying the cards scored during play of the game. Each pocket is provided with a switch electrically connected to the score board and since some of the pockets score negatively, or erase previously scored cards, the game serves to develop skill and requires mental thought and strategy during play. Thus, a more skillful player may ordinarily shoot for a higher scoring card hand, whereas a less skillful player would concentrate on erasing his opponent's scored cards.

Prior art amusement devices and game apparatus include U.S. Pat. No. 1,578,005 which adapts a conventional pool table so that it may be used to play poker. Here the game board is provided with pockets having pictorial representations corresponding to the characters of Playing cards, including card descriptions, such as "Joker", "Jackpot", "Dead hand", or "Royal flush". The board is provided with 53 holes or pockets arranged in any suitable order. A cue ball is provided to shoot at the playing balls so that they enter the pockets for establishing a player's hand.

In U.S. Pat. No. 1,784,068, two players using 5 balls each roll the balls into separate compartments of a game apparatus. The compartments each have 21 pockets and cards held on a device which raises the card vertically to an upright position when a ball is pocketed. Another U.S. Pat. No. 1,678,573, relates to an amusement game or device having electrical switches for actuating various indicia on a display board. This game has thirty pockets at the end of an elongated alley-like playing table, and a pair of contact members in the pockets closed by virtue of the weight of a sponge rubber ball. An electric circuit closed thereby activates a corresponding indicator on a display board or illuminates a lamp disposed behind a star-shaped symbol or emblem.

Other examples of earlier pool game devices are disclosed in U.S. Pat. Nos. 453,674; 497,452; 1,163,412 and 1,220,420.

SUMMARY OF THE INVENTION

It is, therefore, an important object of the present invention to provide an improved poker pool game device involving both skill and strategy.

Another object of the present invention is to provide a game construction having the advantageous characteristics mentioned in the preceding paragraphs, and one which is capable of economic manufacture and exhibits durability throughout a long service life.

Other objects and advantages of the instant invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
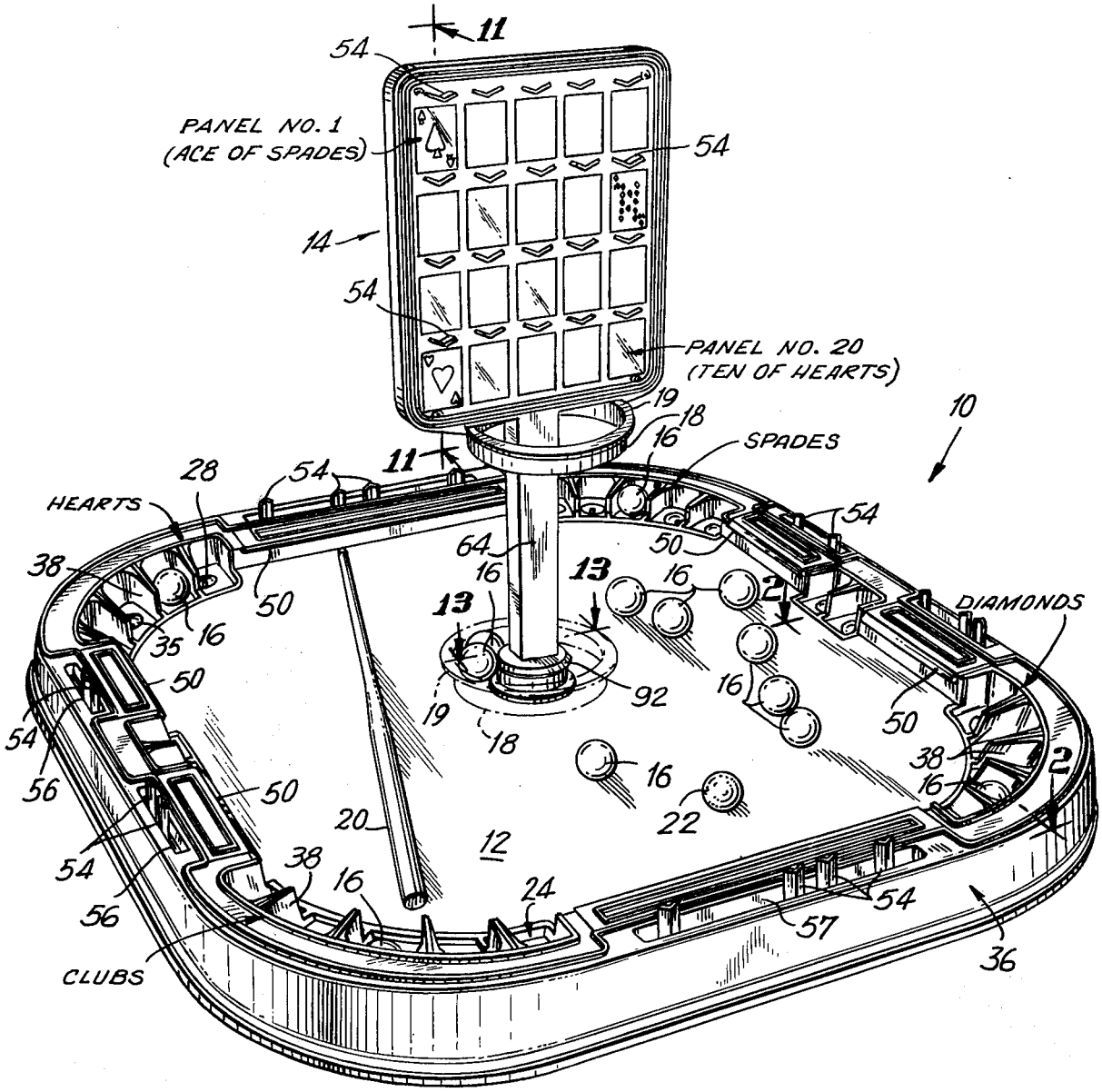
FIG. 1 is a perspective view, showing a game construction of the present invention, with the score board or "lollipop" shown set up in a vertical position in the center of the playing surface.

Referring now to the drawings and more particularly to FIGS. 1–6, the poker pool game of the present invention is generally illustrated by the reference numeral 10. The game comprises a playing surface 12 in the form of a pool table, generally of rectangular or square shape, an illuminating display board 14 or "lollipop", a plurality of balls 16 (ten in number) and a rack 18, having an upper flange 19, for setting the balls for a break. A cue stick 20 and a cue ball 22 are used for striking the balls 16 during play of the game.

Figure 2:
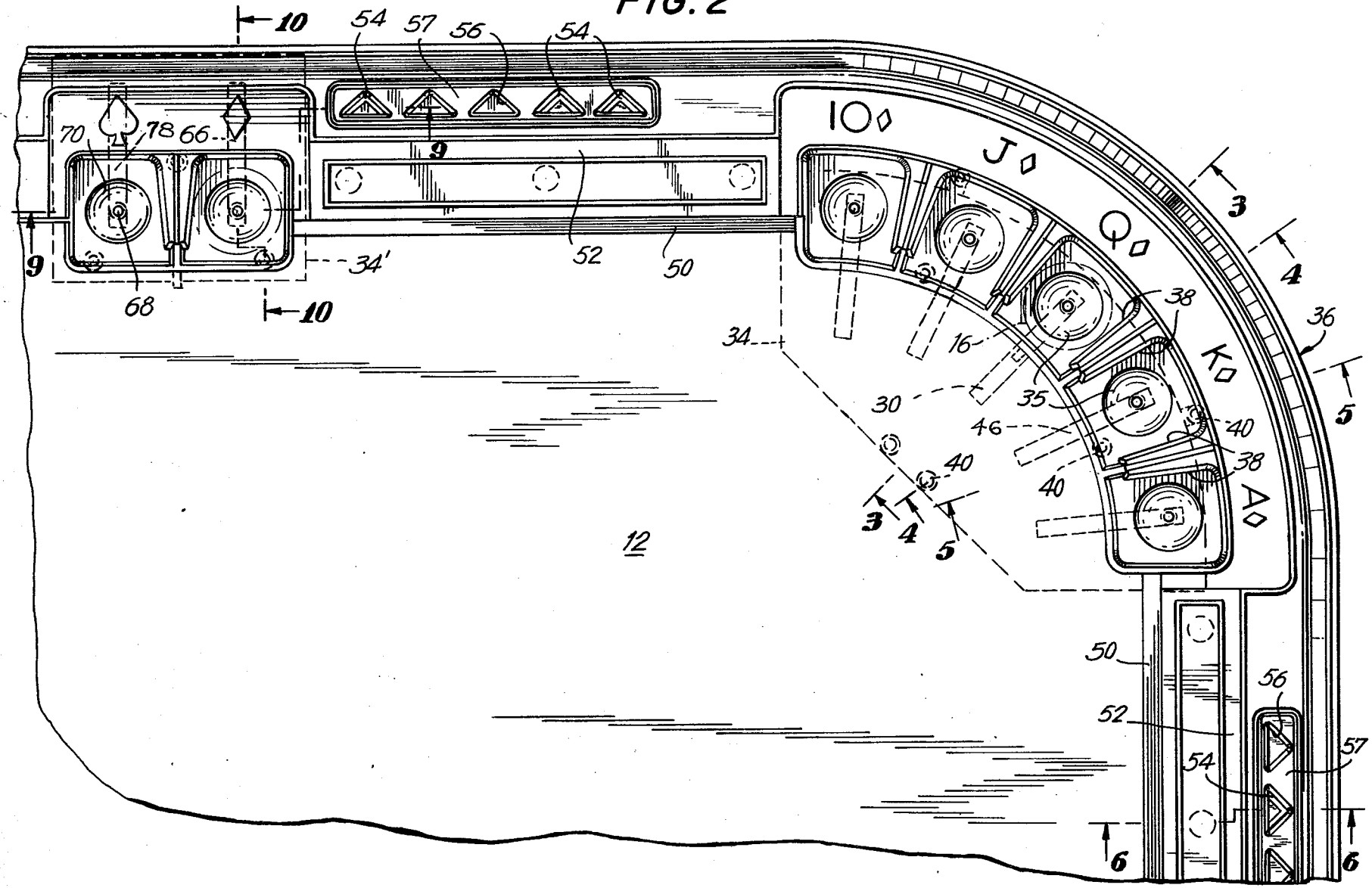
FIG. 2 is an enlarged fragmentary plan view, of one of the typical corners of the board or playing surface, illustrating a suit of cards (ten of diamonds-ace of diamonds)
Figure 3:
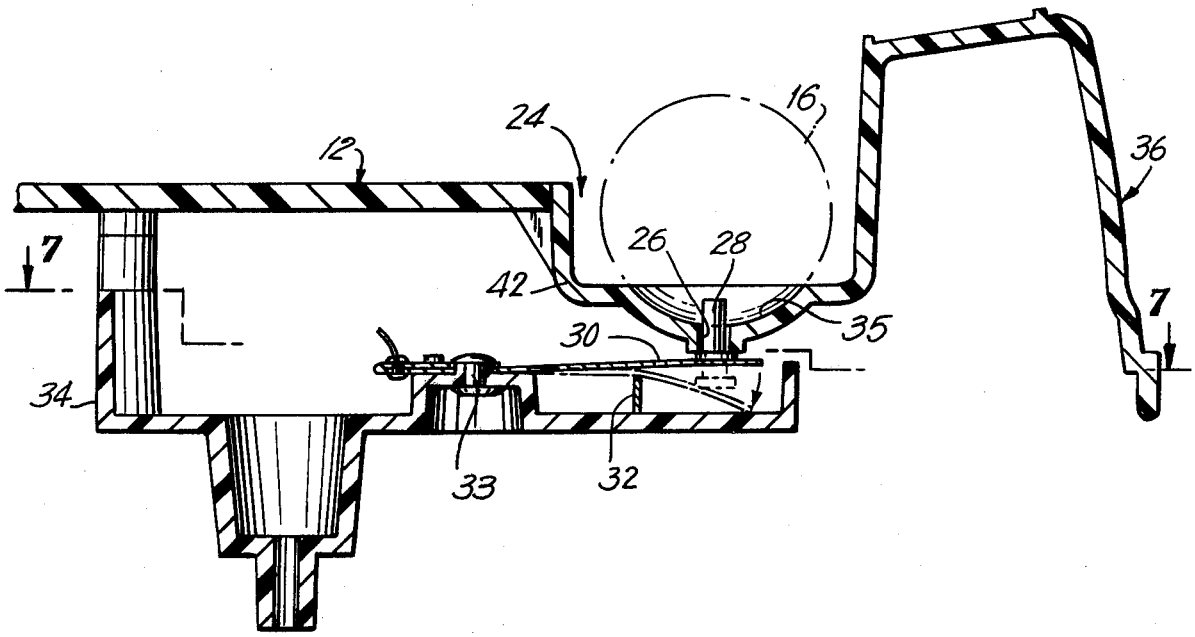
FIG. 3 is a partial sectional view, taken along the line 3—3 of FIG. 2.

As best shown in FIG. 2, a typical corner of the playing surface 12 is illustrated in an enlarged fragmentary plan view. Each corner comprises five pockets representing assigned or predetermined indicia, for example, a suit of cards (spades, hearts, clubs and diamonds), ten of diamonds-ace of diamonds being shown, and on two opposite side surfaces, two pair of side pockets consisting of four holes, each one representing just a suit. In FIG. 3, which is taken through the center of a typical corner pocket, a ball 16 is shown, in phantom, seated in the pocket 24, representing the Queen of Diamonds. Switches communicating with the illuminating score board 14 are provided for all of the pockets. Thus, for example, at the base of the pocket 24 is an aperture 26 for the passage of a contact button or pin 28 biased upwardly into the pocket 24 by a resilient electrically conductive contact strip 30. The resilient contact strip 30 is also shown therein in phantom deflected downwardly by the weight of the ball 16 and making electrical switching contact with a conductive corner pocket bus bar 32. The resilient contact strip 30 is suitably held in place by a conventional fastener 33, such as a rivet, to the lower half portion 34 of the housing 36 forming the overall playing surface 12 of the game device. The bottom of the pocket 24 may be suitably curved or concave in shape, as shown at 35.

Figure 4:
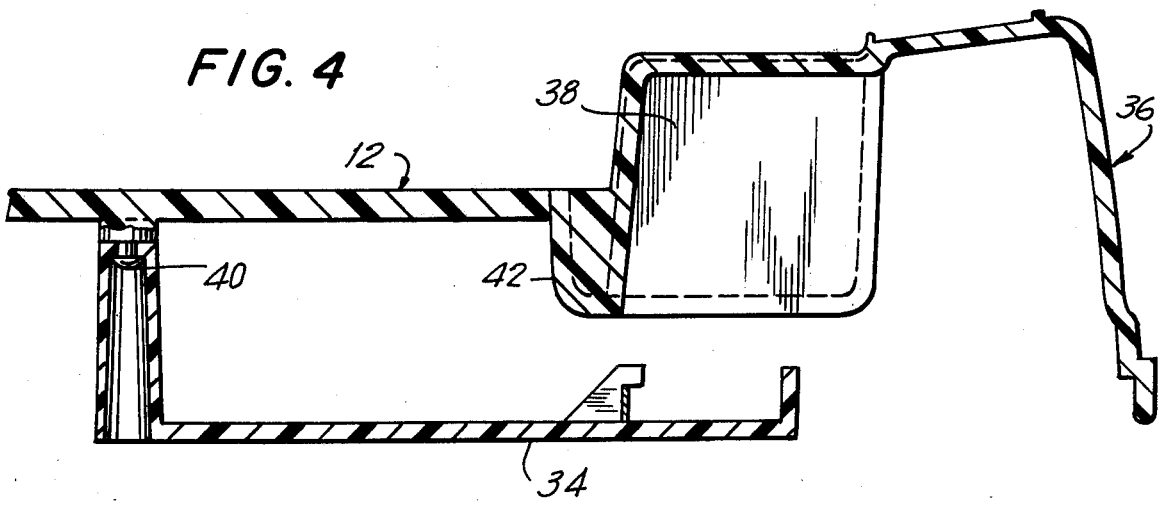
FIG. 4 is a partial sectional view, taken along the line 4—4 of FIG. 2.
Figure 5:
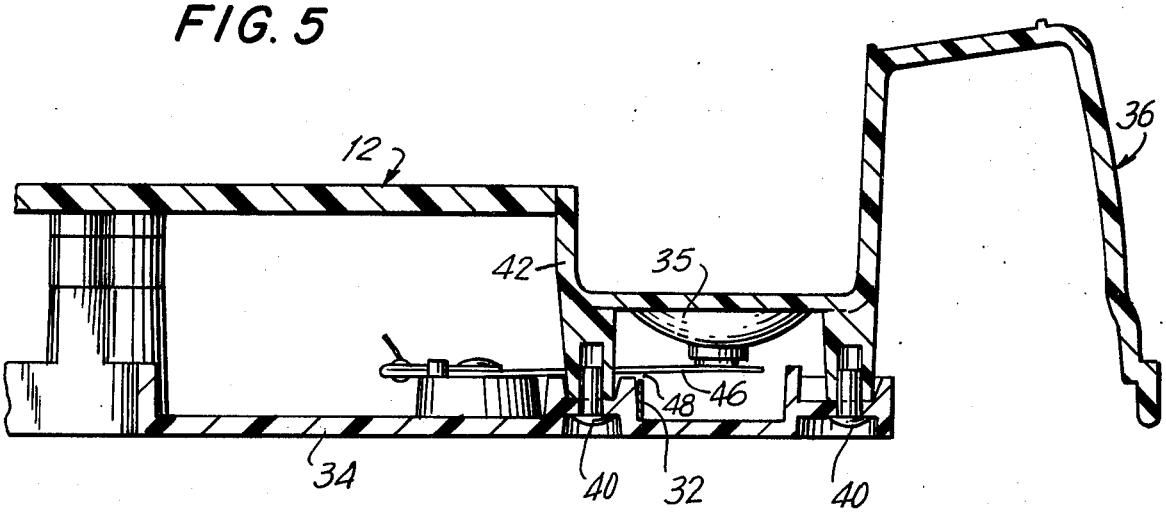
FIG. 5 is a partial sectional view, taken along the line 5—5 of FIG. 2.
Figure 6:
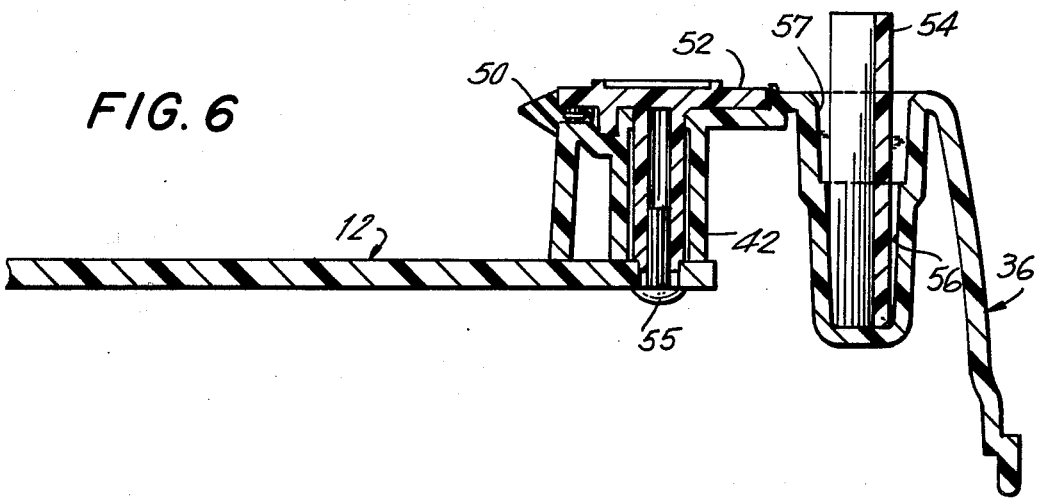
FIG. 6 is a partial sectional view, taken along the line 6—6 of FIG. 2.

FIG. 4 shows a side wall portion 38 of the pocket 24 and also illustrates a conventional fastener 40 securing together the lower half portion 34 of the game's housing 36 to the upper half portion 42. In FIG. 5, the pocket 44, representing the King of Diamonds, is shown without a playing ball seated in the pocket, and the resilient contact strip 46 is shown in its normal unbiased open circuit condition with a gap 48 between the strip 46 and the bus bar 32. A bumper guard 50 is disposed generally about the periphery of the playing surface 12, along the straight edges, between the corner pockets and the side pockets, as best shown in FIGS. 1 and 6. As shown in FIG. 6, the bumper guard 50 may be suitably secured to the housing 36 by being wedged or held in place between the uppper half portion 42 and a top strip element 52. A suitable fastener 55 may be used to hold the top strip element 52 down against the bumper guard 50, and to secure the playing surface 12 to the upper half portion 42 of the overall housing 36 of the game. Playing pieces 54, as will be explained hereinafter, are stored in relatively deep recesses 56 in a trough 57 disposed along the straight side portions of the housing 36, on both sides of the two pair of side pockets and between the corner pockets.

Figure 7:
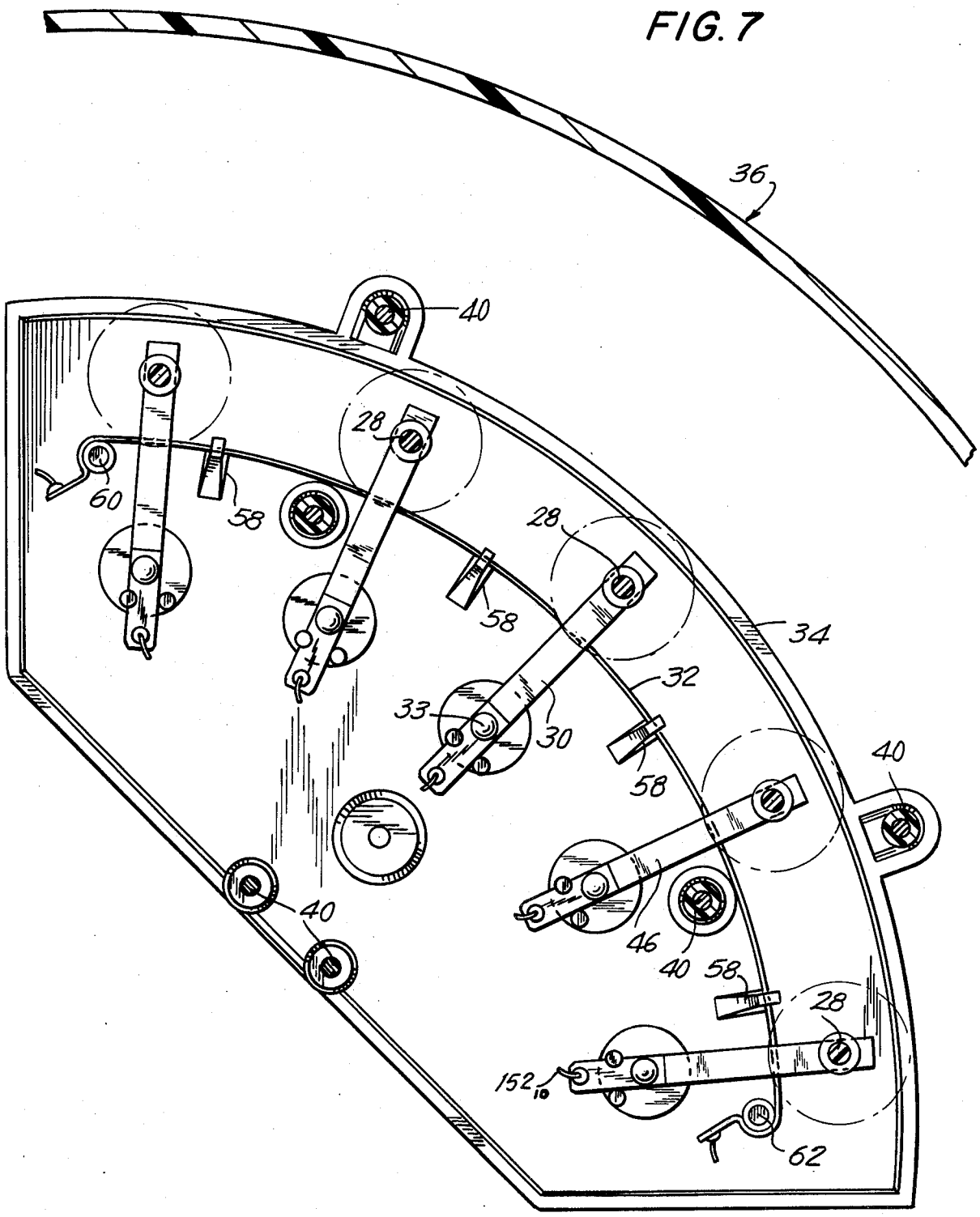
FIG. 7 is a partial sectional view, taken along the line 7—7 of FIG. 3.

The bus bar 32, as shown in FIG. 7 is held vertically in place by means of a plurality of upright supports 58, and is suitably secured about end posts 60 and 62. Each of the five contact strips for all of the four corner pockets are disposed horizontally above the bus bars so as to be in a normally open circuit condition. Once a ball 16 is pocketed, electrical contact is established, and the electrical circuit which is closed is electronically registered on the "lollipop" or illuminating display score board 14 which is held upright by a post 64. The circuitry with respect to this scoring will be explained hereinafter with respect to FIG. 15.

Figure 8:
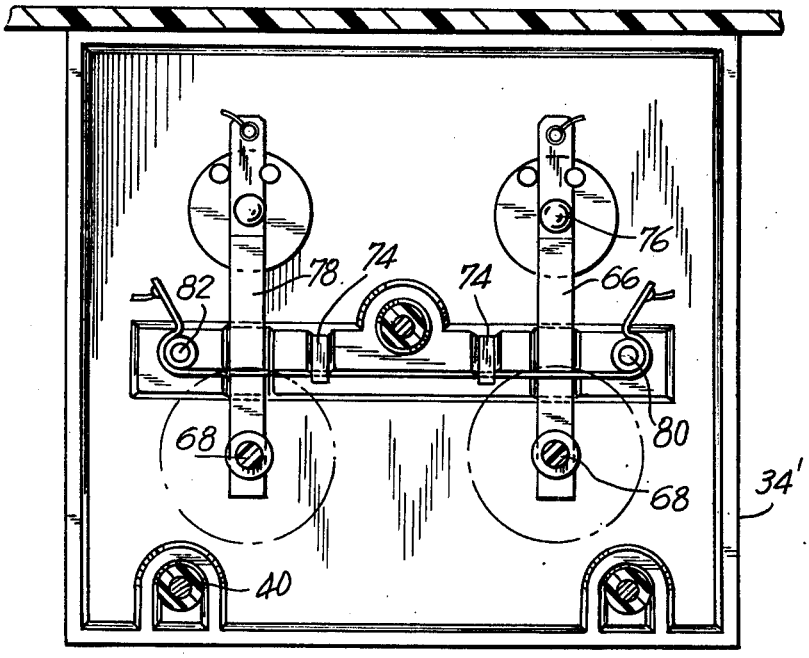
FIG. 8 is an enlarged fragmentary plan view, of one of the pair of side pockets, with the board or playing surface removed.
Figure 9:
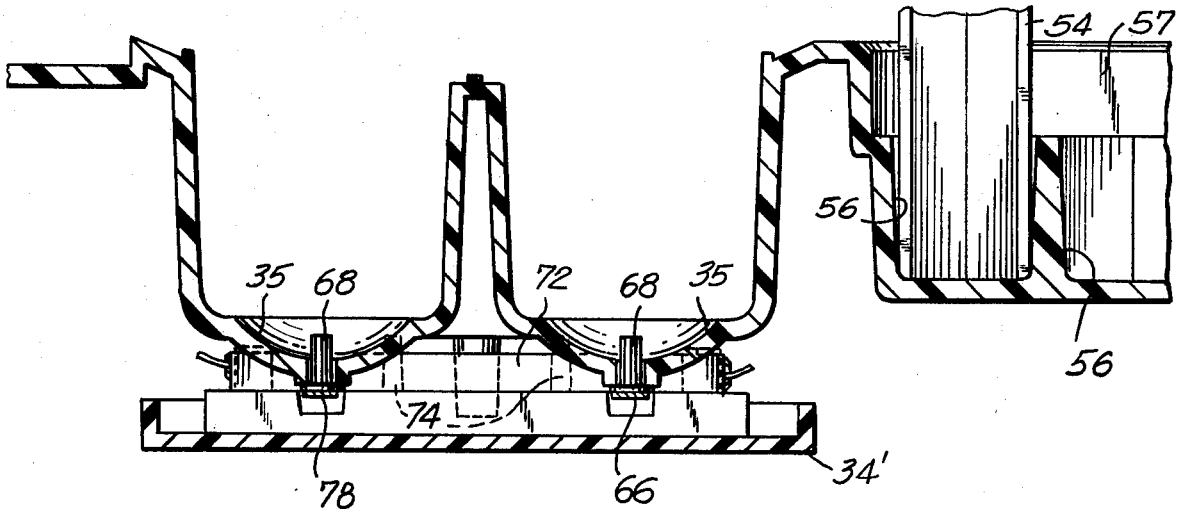
FIG. 9 is a partial sectional view of a pair of side pockets, taken along the line 9—9 of FIG. 2.
Figure 10:
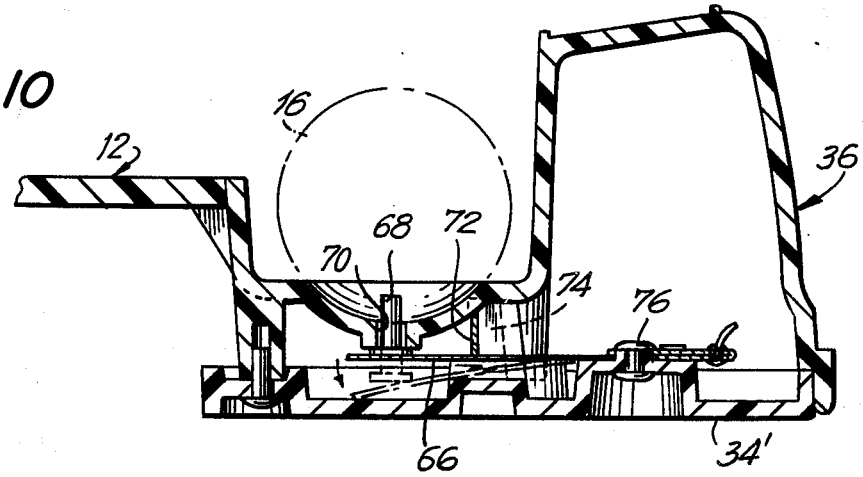
FIG. 10 is a sectional view through a resilient contact strip, taken along the line 10—10 of FIG. 2.

Returning now to the pair of side pockets illustrated in FIG. 2 and FIGS. 8–10, each one of the four side pockets simply represents a suit, such as spades, hearts, clubs or diamonds. FIG. 10, for example, is a section taken through the resilient contact strip 66 disposed beneath the diamond side pocket and such strip 66 bears against the contact button or pin 68 extending through the aperture 70 at the base or bottom of the pocket. The button 68 and contact strip 66 are also shown in phantom in the open circuit condition inasmuch as all of the side pockets have contact strips in a normally closed electrical circuit condition. Thus, the contact strip 66, is normally in electrical contact with a vertically disposed bus bar 72 held in place by upright supports 74, identical to the supports 58 shown in FIG. 7 with respect to the four corner pockets. A suitable fastener, such as a rivet 76, secures the strip 66 to the lower half portion 34′ of the housing 36 and also forms the pivot point about which the contact strip 66 deflects upon the weight of a ball 16 bearing on the button 68.

As shown in FIGS. 8 and 9, the electrical bus bar 72 extends beneath the contact strip 66 of the diamond side pocket and beneath the contact strip 78 of the spade side pocket. Both strips 66 and 78 are in a normally closed circuit condition and are thus electrically contacting the bus bar 72. Bus bar 72, which is disposed vertically in place by means of the upright supports 74, is also suitably secured about end posts 80 and 82, similar to the end posts 60 and 62 of FIG. 7.

Figures 11, 12:
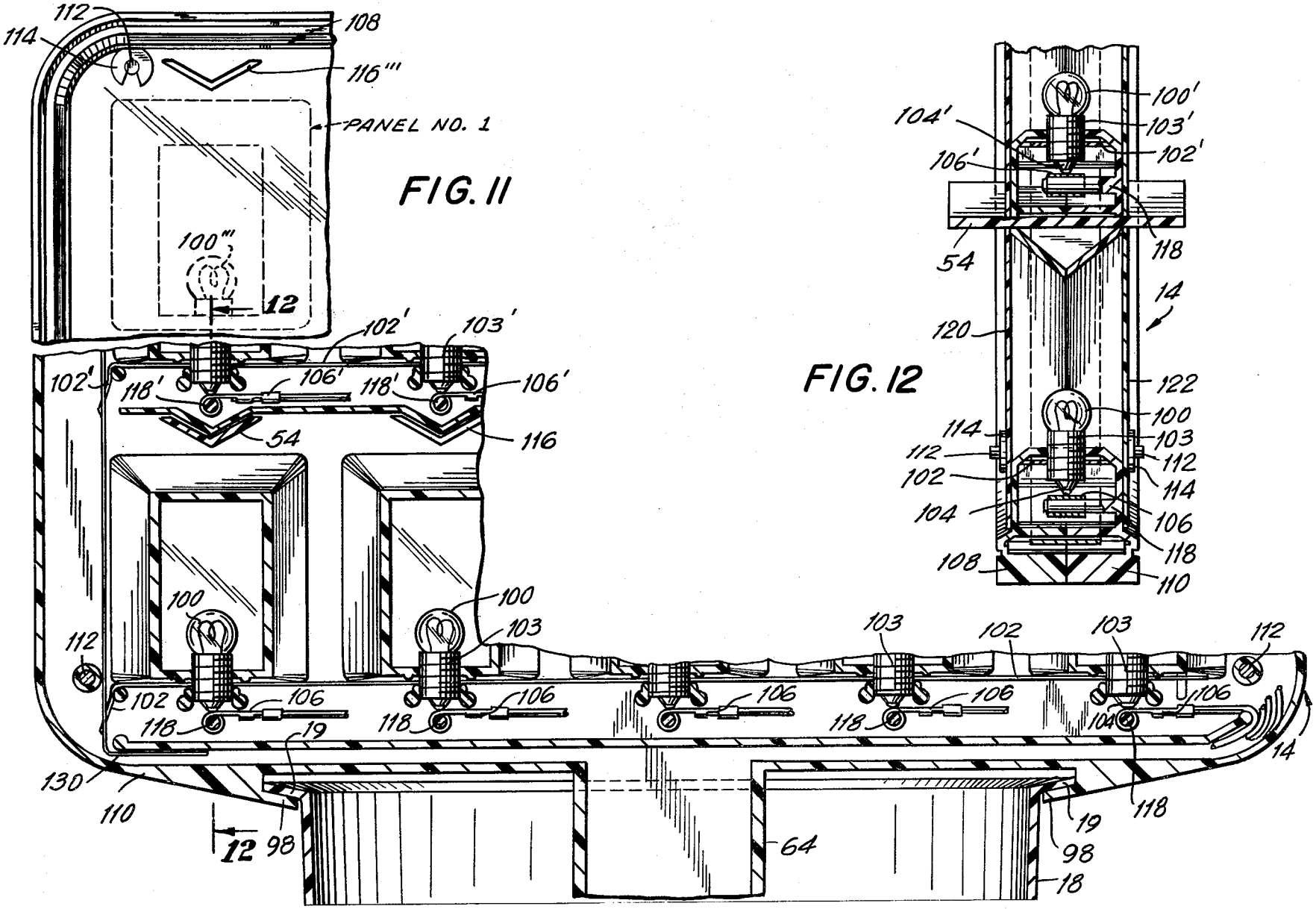
FIG. 11 is a partial sectional view, taken along the line 11—11 of FIG. 1.
FIG. 12 is a partial sectional view, taken along the line 12—12 of FIG. 11.
Figure 13:
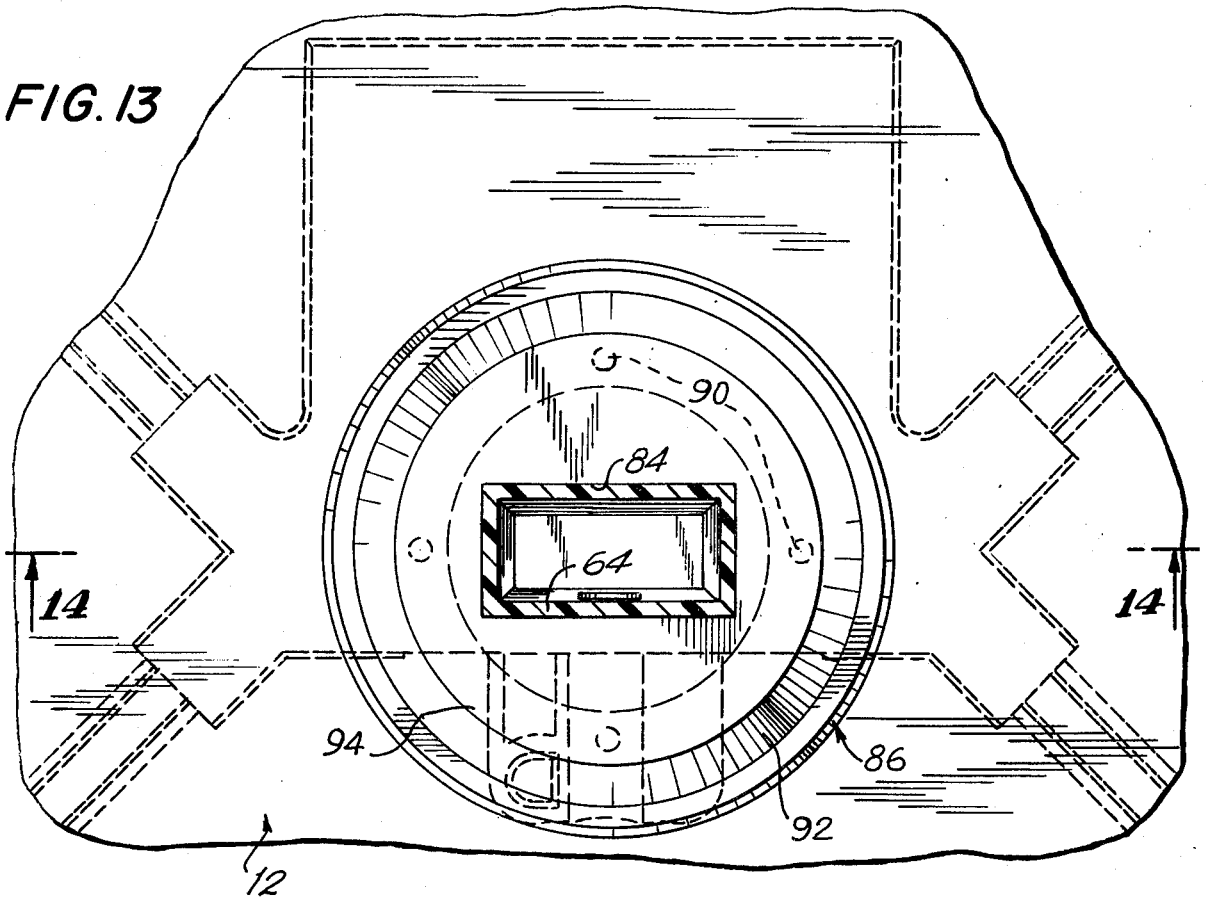
FIG. 13 is an enlarged plan view, of the center portion of the playing surface showing the recess for the post of the score board, taken along the line 13—13 of FIG. 1.
Figure 14:
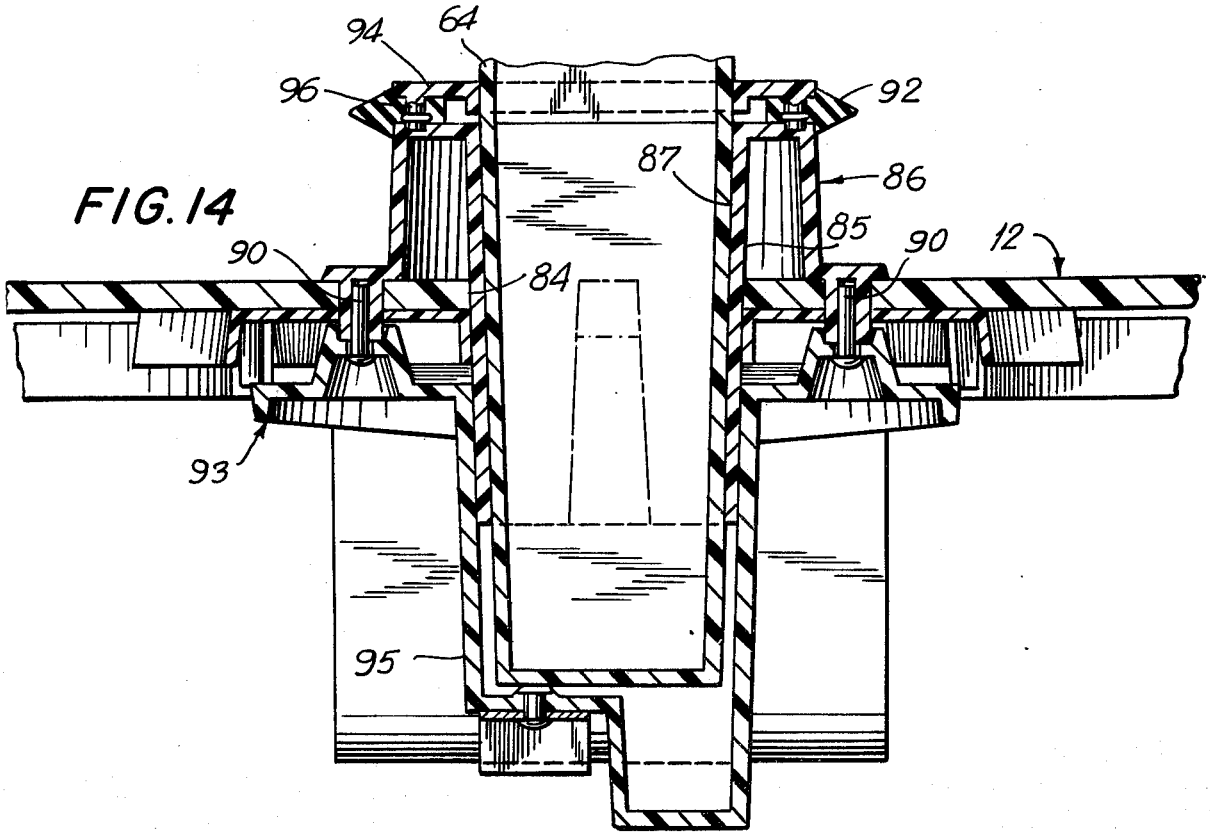
FIG. 14 is a partial sectional view, taken along the line 14—14 of FIG. 13.

Referring to FIGS. 11 and 14, the central portion of the playing surface 12, as shown in FIGS. 13 and 14, is illustrated with a generally rectangular aperture 84, within which is disposed an outer holder 86 having a tapering bore 87 and a flange portion 88 for vertically supporting the score board 14 and its post 64. The inner wall 85 of the holder 86 having the tapering bore 87 is fitted into the aperture 84 and the flange portion 88 is suitably held in place to the playing surface 12 of the game device by any suitable means, such as conventional threaded fasteners 90. A lower supporting holder 93 having an inner wall portion 95 is employed to aid in supporting the inner wall portion 85 of the holder 86 and it likewise is secured by the fasteners 90 to the holder 86 and to the playing surface 12. A suitable circular bumper guard 92 is held in place to the upper portion of the holder 86 by means of a top cover element 94 having downwardly extending prong-like elements 96.

It will be appreciated that the illuminating score board 14 and its supporting post 64 may be removed by lifting same out of the tapering bore 87 of the holder 86. This enables the game to be more easily stored, since the score board 14 can be positioned for storage flat across the playing surface 12. In such case, the electrical wiring disposed beneath the playing surface 12, as will be explained in greater detail in connection with FIG. 15, would be provided with sufficient slack so as to permit storage of the score board in such a manner. Of course, other alternative constructions may also be employed. For example, the score board 14 may be simply pivoted to the playing surface 12 about the bottom end of the post 64; or mutually co-operatively associated mating electrical contact elements may be provided on both the post and on the tapering bore of the outer holder enabling complete separation of the score board from the playing surface.

FIGS. 11 and 12 illustrate the illuminating display score board 14 in greater detail. As shown therein and in FIG. 1, the rack 18 may be conveniently stored or held in place when not in use to the bottom of the score board 14 by means of its flange 19 engaging in a wedge-like fashion with a pair of inwardly facing or extending lips or flanges 98 provided on the bottom surface of the score board 14.

The score board 14 is equipped with a lamp or light 100 for each predetermined or assigned indicia panel (20 shown) to be displayed. In the present construction, four rows of lamps are shown, row I being at the top of the display board and row IV at the bottom thereof. For the poker pool game of the invention, five lamps are required for each of the four rows. Each lamp 100 (100′, 100″, and 100‴)of a row is electrically connected to a common terminal 102 (102′, 102″, and 102‴) contacting each screw socket 103 (103′, 103″, and 103‴) terminal connection of the five lamps in such row. The center contact terminal 104 (104′, 104″, and 104‴) of each lamp 100 is separately and individually connected electrically to the overall circuitry by means of a connector 106 (106′, 106″, and 106‴) engageable with the terminal 104 for each lamp 100. As will be explained hereinafter in connection with FIG. 15, individual wires $152_{1-20}$ representing an individual wire connected to the connector 106 (106′, 106″ and 106‴) which in turn is electrically in contact with the terminal 104 (104′, 104″ and 104‴) of each lamp 100 (100′, 100″ and 100‴).

The score board 14 further comprises two halves 108 (front) and 110 (rear) suitably held together by fasteners, such as pins 112 and C-shaped snap retainers 114. Above each of the twenty indicia panels is an aperture 116 (116′, 116″, and 116‴) piercing the display score board 14 for accommodating the playing pieces 54, one of which is best shown in FIG. 12 extending through the score board which is visible from both sides thereof.

The connectors 106 are conveniently held about suitable posts 118 (118′, 118″ and 118‴) extending from the half 110 of the score board 14. The front and rear illuminating surface portions of the score board 14 are suitably covered with translucent or even transparent panels 120 and 122, respectively; and these panels may have suitably provided thereon the predetermined or assigned indicia markings which are visible when the lamp immediately behind it is illuminated. In the present invention described herein, the markings are those corresponding to the four suits of the corner pockets. The electronic play of the game will be described hereinafter, but it should be recognized at this time, that a manual mode of operation is also within the scope of the invention, and each player would simply place (or remove) a "playing" card (or cards), corresponding to the particular pocketed ball, in slots or grooves (not shown) on the twenty panel surfaces of the score board so as to be visible to the players.

As noted hereinbefore, each of the four corner pockets correspond to a row of lamps for a suit of cards, i.e. ten – ace. Starting with the upper right hand corner of the poker pool game shown in FIG. 1, these corner pockets represent, for example, a spade suit; the upper left hand corner pockets, hearts; the lower left hand corner pockets, clubs; and the lower right hand corner pockets, diamonds, as clearly shown in FIG. 2.

Figure 15:
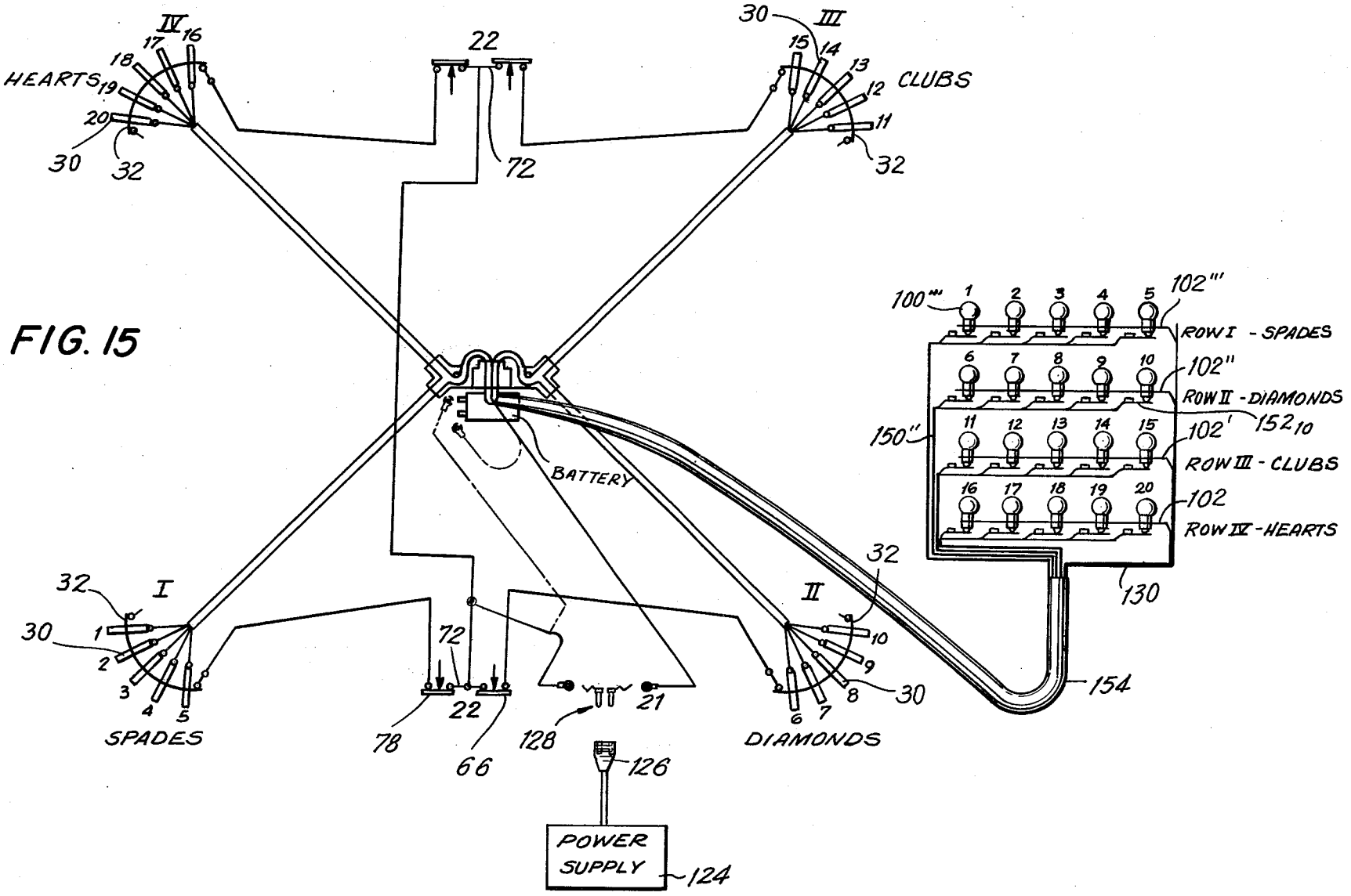
FIG. 15 is a schematic diagram illustrating the electrical circuitry of the invention.

Referring now to FIG. 15, pocket No. 1 is the ace of spades, pocket No. 2 is the king of spades and so forth. Pocket No. 6 is the ace of diamonds, pocket No. 11 is the ace of clubs and pocket No. 16 is the ace of hearts. The ace of spades is displayed at panel No. 1 of row I, the king of spades at panel No. 2, etc. In a like manner, the ace of diamonds is displayed at panel No. 6, ace of clubs at panel No. 11, and ace of hearts at panel No. 16.

Reference point 21 shown in the wiring diagram is representative of a conventional on-off type of switch, such as a single pole, single throw switch. A suitable power supply 124, which may be in the form of a standard or rechargeable D.C. battery or pack (the wiring for same being shown by the phantom lines) or even an A.C. rectified power pack of relatively low voltage may be employed to power the overall wiring network. The power supply is provided with a conventional female connector 126 and the input to the game device comprises a mating male connector 128.

As best shown in FIGS. 11 and 15 the common "hot" line 130 is connected to all of the lamp terminals 103, 103′, 103″ and 103‴ by means of the common terminal contact strip 102, 120′, 102″ and 102‴. Each lamp 100 is individually wired as shown in the schematic representation of the score board in FIG. 15. Thus, although all of the connectors of each row have the same reference numeral 106 (106′, 106″ and 106‴), the individual wires or conductors are identifiable by the lamp or panel numbers 1–20.

Conductor 150″ (150, 150′ and 150‴) is representative of either a bundle of five wires or conductors or a coaxial cable with five conductors. Each conductor being connected at one end to a single lamp 100 illuminating its respective panel representing the pocketed ball it is connected to on its other end. For example, panel No. 10 represents the ten of diamonds. A wire $152_{10}$ is connected via 106″ to the base 104″ of lamp 100″. This wire $152_{10}$ is one of the five internal wires of the wire 150″. Conductor 154 is a bundle of five wires or conductors or a coaxial cable with five conductors. One of these wires is the hot line 130 which continues through the wire 154 to the battery or other power supply of the game device. The other four wires 150, 150′, 150″ and 150‴ continue through wire 154 to their respective corner pocket sets.

In the example shown, wire 150″ goes through the wire 154 and comes out in the diamond corner pocket zone. At this point, wire $152_{10}$ emerges from the wire 150″ and is connected to its respective contact strip which corresponds to the ten of diamonds pocket.

It should be recognized that in this particular set up all flushes will be royal straight flushes. However, if the game were to be constructed with more pockets, thus representing more cards of a deck, it would then be possible to achieve a flush, without also achieving a straight flush or a royal straight flush. It is also possible if the game were made sufficiently large to have 13 pockets for each suit and thereby representing all 52 cards of the deck, thus making it possible to achieve all legal poker hands. It is also possible to construct a game with a pocket or pockets that can represent any card the player choses. A game may also be constructed on a smaller scale putting in four pockets or less for each suit. Under this construction, certain hands, such as a flush or straight, might not be possible.

Another possibility is to have a pocket for a wild card which is connected to a lamp lighting up a wild card panel or the lollipop (lamp not shown). With such an arrangement, the player who scored the wild card may use it to represent any card he choses even though it might already have been achieved by another or himself. A wild card chosen to represent a given card would not negate that card if that card were achieved at a later point in time in the game. The game can also be played where the wild card cannot represent a card already achieved and may negate a card achieved in subsequent plays.

Thus, it is also possible to play any card game the player choses provided there are enough cards exhibited on the lollipop. For example, even with the score board as shown, rummy could be played. It is also possible to play any card game invented by the players on the lollipop. Thus, the cards can represent things other than conventional playing cards to allow the players to play games other than card games.

Each lamp may therefore be individually lighted upon the pocketing of a ball in any of the corner pockets since the ball enables the resilient contact 30 to make electrical contact with the bus bar 32. In addition, since each side pocket is electrically in series with one of the four corner pocket sets, each time a ball is pocketed in such side pocket, all of the lighted lamps of such suit (corner pockets) will be electrically disconnected since the ball enables the contact strip 66, 68, etc. to break electrical contact with the bus bar 72. It is not believed necessary to further describe the electrical harness and wiring bundle arrangements as well as the remaining wiring of FIG. 15 since same is believed to be conventional in the art.

In operation, the poker pool game of the present invention is preferably played by two players or by two teams of two players each. The playing pieces 54 are suitably color coded so as to distingish players and/or teams of players. A game is commenced by first setting the ten balls around the center bumper 92 with the rack 18. The rack is then removed and stored beneath the score board 14, as shown in FIG. 1. The cue ball will be positioned opposite from the set balls and a first player will break. The objective of a player is to shoot for a poker hand and each hand will have a score value. The higher the hand, the higher the score one achieves. The game ends, for example, when one player or team scores 100.

The players rotate turns and when a player shoots a ball into a corner pocket, the corresponding lamp and panel will light up on the score board indicating the card scored or achieved. At such time, the player will place his playing piece or marker for fast and clear indications of his condition on the lollipop or score board. It will be appreciated that the game involves both skill and strategy. A skillful player may shoot for a higher hand, whereas an unskillful player can compensate his inability to compete in a fair manner by using the side pockets to erase his opponent's cards from the score board. At such a condition or point where a score is erased, the opponent (as well as the shooter) will have to pull the balls out suit the pockets of the erased sit and return them to center for use in subsequent plays. Of course, the colored playing pieces or markers would also be likewise removed from the score board and repositioned in their respective holders along the flat side portions of the game device.

Scoring, for example, may be as follows:

| | |
|---|---|
| Royal straight flush | 9 points |
| Straight flush | 8 points |
| Four of a kind | 7 points |
| Full house | 6 points |
| Flush | 5 points |
| Straight | 4 points |
| Three of a kind | 3 points |
| Two pair | 2 points |
| One pair | 1 point |

Of course, other values may be set for the various hands by the players and the game may also end in any other manner determined by the players, rather than by the first one who scores 100.

While the invention has been described, disclosed, illustrated and shown in terms of an embodiment or modification which it has assumed in practice, the scope of the invention should not be deemed to be limited by the precise embodiment or modification herein described, disclosed, illutrated, or shown, such other embodiments or modifications as may be suggested to those having the benefit of the teachings herein being intended to be reserved especially as they fall within the scope and breadth of the claims here appended.

What is claimed is:

1. A pool-like game employing a plurality of balls comprising: a level or horizontal playing surface, a plurality of ball receiving pockets about said playing surface, conductive contact means in each of said pockets responsive to a pocketed ball, means in the form of a score board having a predetermined indicium for each of said pockets, and being electrically connected to said conductive contact means, for scoring said indicium upon response to a pocketed ball; at least one, but not all of said conductive contact means being normally closed and removing from said score board means the scored indicium for at least one pocketed ball; and means for supplying electrical power to said score board means.

2. The pool-like game according to claim 1, wherein said playing surface is generally square in shape, and said ball-receiving pockets include a plurality of ball receiving corner pockets and ball receiving side pockets disposed about the periphery of said playing surface.

3. The pool-like game according to claim 1, wherein said means in the form of a score board is provided with a front and rear side, and both of said sides having the identical predetermined indicium for each of said pockets, thereby enabling visual observation of a score from either side thereof.

4. A pool like game employing a plurality of balls, comprising: a generally horizontal, generally square in shape playing surface; 20 ball-receiving corner pockets, each corner of said playing surface having a set of corner pockets; a plurality of ball-receiving side pockets disposed about the periphery of said playing surface; conductive contact means in each of said corner pockets and each of said side pockets responsive to a pocketed ball; means in the form of a score board having a predetermined indicium for each of said corner pockets, and being electrically connected to said conductive contact means, for scoring said indicium upon response to a pocketed ball; means for supplying electrical power to said game for energizing said score board means; at least one, but not all, of said conductive contact means is normally closed and removes from said score board means the scored indicium for at least one pocketed ball; and at least one of said sets of corner pockets is electrically connected in series to one of said pockets having the normally closed conductive contact means.

5. The pool-like game according to claim 4, including four side pockets, each one of which is electrically connected in series to one of said sets of corner pockets, for removing scored indicia from the score board representing said set of corner pockets having pocketed balls.

6. The pool-like game according to claim 5, including lamp means for illuminating each indicium to be displayed on the score board responsive to a pocketed ball.

7. The pool-like game according to claim 5, wherein each set of corner pockets represents an ace-ten of a suit of cards, and each side pocket represents a suit.

8. The pool-like game according to claim 7, wherein said score board means comprises four rows, and each of said rows having indicia corresponding to each set of corner pockets.

9. The pool-like game according to claim 4, wherein said conductive contact means comprises a resilient conductive strip element for each of said pockets and a common, conductive bus bar means for said sets of pockets.

10. The pool-like game according to claim 9, wherein said strip elements are normally in an open circuit position with respect to said common, conductive bus bar means.

11. The pool-like game according claim 10, including non-conductive pin means, in each of said plurality of pockets, engageable with strip elements for moving same into electrical contact with said common, conductive bus bar means upon the pocketing of a ball in a said pocket of said plurality of pockets.

12. A pool-like game employing a plurality of balls, comprising: a generally horizontal playing surface; a plurality of ball-receiving pockets about said playing surface; conductive contact means in each of said pockets responsive to a pocketed ball; means in the form of a score board having a predetermined indicium for each of said pockets, and being electrically connected to said conductive contact means, for scoring said indicium upon response to a pocketed ball, said means in the form of a score board being generally centrally disposed on said playing surface in a vertical upright position and being removably disposed on said playing surface for storing said score board means horizontally when not in use; and means for supplying electrical power to said game for energizing said score board means.

13. A pool-like game employing a plurality of balls, comprising: a generally horizontal playing surface; a plurality of ball receiving pockets about said playing surface; conductive contact means in each of said pockets responsive to a pocketed ball; means in the form of a score board having a predetermined indicium for each of said pockets, and being electrically connected to said conductive contact means, for scoring said indicium upon response to a pocketed ball, said means in the form of a score board being generally centrally disposed on said playing surface in a vertical upright position and being supported by a post pivotably mounted to said playing surface; and means for supplying electrical power to said game for energizing said score board means.

14. A pool-like game employing a plurality of balls, comprising: a generally horizontal playing surface; a plurality of ball-receiving pockets about said playing surface; conductive contact means in each of said pockets responsive to a pocketed ball; means in the form of a score board having a predetermined indicium for each of said pockets, and being electrically connected to said conductive contact means, for scoring said indicium upon response to a pocketed ball; and means for supplying electrical power to said game for energizing said score board means; playing pieces representing markers, for scored indicia, and said means forming a score board being provided with aperture means for receiving a marker for each predetermined pocket indicium.

15. The pool-like game according to claim 14, wherein said playing pieces are of a different color for each player.

16. The pool-like game according to claim 14, including means on said game for storing said playing pieces.

17. A pool-like game employing a plurality of balls, comprising: a generally horizontal playing surface; a plurality of ball receiving pockets about said playing surface; conductive contact means in each of said pockets responsive to a pocketed ball, means in the form of a score board having a predetermined indicium for each of said pockets, and being electrically connected to said conductive contact means, for scoring said indicium upon response to a pocketed ball, said means in the form of a score board being generally centrally disposed on said playing surface in a vertical upright position; means for supplying electric power to said game for energizing said score board means; rack means for setting up said plurality of balls centrally about said means forming a score board.

18. The pool-like game according to claim 17, wherein said score board means is provided with means for supporting said rack means when not in use.

19. A pool-like game employing a plurality of balls comprising:

a level or horizontal playing surface;

a first set of a plurality of ball-receiving pockets disposed about said playing surface, each of said pockets having a single conductive contact means responsive to a ball disposed in said pocket, said pockets being divided into subsets;

a score board means mounted on said playing surface having an indicium corresponding to each of said pockets in the first set of pockets;

means for connecting the contact in each pocket of the first set of pockets to its corresponding indicium, so that the proper score board indicium will be energized when a ball is disposed in one of the pockets of said first set;

means for supplying electrical power to said game;

a second set of plurality of pockets disposed about said playing surface, each of said pockets having a single conductive contact that is caused to open when a ball is disposed in that pocket of said second set; and means for short circuiting a predetermined subset of the first set of pockets when a ball has been disposed in a pocket of the second set of pockets.

20. A pool-like game comprising a level or horizontal playing surface adapted for receipt of a plurality of playing balls thereon, a generally upstanding side wall substantially completely surrounding said playing surface, a plurality of ball-receiving pockets, said pockets being arranged in groups at specific locations about the periphery of said playing surface within said wall, each of said pockets including an opening confronting said playing surface, each of said pockets further including conductive contact means being constructed and arranged to close a contact in response to receipt of a ball therein, generally upstanding score board means centrally disposed relative to said playing surface, at least one indicium proximate each one of said ball-receiving pockets, a plurality of indicia on said score board, each of said score board indicia corresponding to one of the indicia proximate one of said ball-receiving pockets, said game including means being constructed and arranged for denominating one of said indicia on said score board upon a ball being received within one of said ball-receiving pockets including proximate thereto a corresponding indicium.

* * * * *